US005748062A

United States Patent [19]

Kirkpatrick

[11] Patent Number: 5,748,062

[45] Date of Patent: May 5, 1998

[54] FABRICATED ELECTRIC LIFTING MAGNET

[76] Inventor: Jay Albert Kirkpatrick, 9302 Lakeland Dr., Richmond, Va. 23229

[21] Appl. No.: 659,179

[22] Filed: Jun. 6, 1996

[51] Int. Cl.[6] ..... H01F 7/20

[52] U.S. Cl. ..... 335/294; 335/2; 294/65.5

[58] Field of Search ..... 335/285–295; 294/64.1, 65.5; 174/50; 248/906; 52/20, 82, 298, 301, 334, 729.1, 729.2, 72.3, 731.1, 731.2

[56] References Cited

U.S. PATENT DOCUMENTS

| | | | |
|---|---|---|---|
| 1,015,728 | 1/1912 | Eastwood | 335/292 |
| 1,325,914 | 12/1919 | Rowell . | |
| 1,532,449 | 1/1925 | Sederholm | 335/291 |
| 2,219,244 | 10/1940 | White et al. | 294/65.5 |
| 2,446,973 | 8/1948 | Zeigler | 294/65.5 |
| 2,491,743 | 12/1949 | Lillquist | 335/291 |
| 2,761,094 | 8/1956 | Frampton . | |
| 2,837,702 | 6/1958 | Blind | 294/65.5 |
| 3,283,464 | 11/1966 | Litzka | 52/731.1 |
| 3,621,423 | 11/1971 | Swope | 335/290 |
| 3,984,796 | 10/1976 | Frampton | 335/291 |
| 4,009,459 | 2/1977 | Benson et al. | 335/300 |
| 4,112,248 | 9/1978 | Leive | 174/50 |
| 4,414,522 | 11/1983 | Ryback | 335/291 |
| 4,594,568 | 6/1986 | Hubner et al. | 335/289 |
| 5,038,128 | 8/1991 | Georgiev et al. | 335/290 |

FOREIGN PATENT DOCUMENTS

| | | | |
|---|---|---|---|
| 2307933 | 11/1976 | France | 52/731.2 |
| 29863 | of 1912 | United Kingdom | 335/291 |

*Primary Examiner*—Michael L. Gellner
*Assistant Examiner*—Raymond Barrera
*Attorney, Agent, or Firm*—Oliff & Berridge PLC

[57] ABSTRACT

An electric lifting magnet includes a casing that is fabricated entirely from components such as, for example, structural steel that are welded together. In particular, the lifting magnet includes a flat top plate that is stiffened and supported by a frame that is welded to the top plate. The frame includes a plurality of stiffeners that extend from the center of the top plate to the radially outer edges of the top plate, the stiffeners being welded together at the center of the top plate. The stiffeners are shaped and arranged on the top plate so that the frame that they form can bear the entire load that the lifting magnet is designed to withstand.

29 Claims, 7 Drawing Sheets

FABRICATED ELECTRIC LIFTING MAGNET

BACKGROUND OF THE INVENTION

1. Field of the Invention

The invention relates to electric lifting magnets that typically are used in the steel and scrap industries for lifting large masses of scrap and heavy metal objects.

2. Description of Related Art

Conventional lifting magnets, which are used, for example, in scrap yards and steel mills, have an outer casing that typically is formed from cast steel. A central core is provided in the casing and is surrounded by an electric coil. An outer wall of the casing surrounds the electric coil. The central core and the outer wall respectively function as inner and outer pole shoes when the coil is energized.

In order to provide the appropriate structural integrity, the cast steel casings typically are rather thick and include a top wall that increases in thickness towards the radially central portion of the casing, which bears much of the load, further increasing the thickness. Electric lifting magnets having such conventional cast steel casings are very heavy, typically about 6400–6800 pounds for a standard 66 inch diameter magnet.

Examples of lifting magnets having casings formed by casting are shown in U.S. Pat. Nos. 1,015,728; 1,325,914; 1,532,449; 2,761,094; 2,837,702; and 4,112,248. The cast casings of some of these patents (such as U.S. Pat. Nos. 2,761,094; 2,837,702 and 4,112,248) include radially extending fins on their upper surface to which the lifting chains from the crane are attached. While these lifting magnets are supported from such fins, the fins are not designed and arranged to provide the structural integrity of the lifting magnets. For example, the fins do not extend from the center of the casing to the outer periphery of the top of the casing. The structural integrity of these lifting magnets results from their cast construction of the entire casing, which, as mentioned above, must be rather thick.

Cast steel casings, which have been used since approximately the 1920s, are subject to structural defects caused by excessive porosity (i.e., trapped gases in the cast steel), high sulfur content, etc. Accordingly, the grading of a cast steel casing can vary throughout the casing, causing weak points that are subject to cracking.

Attempts to closely control the porosity of cast steel complicates the manufacturing process and increases the manufacturing cost and still does not result in a material having consistent, well defined characteristics such as cold- or hot-rolled structural steel. Structural steel can be obtained in the form of plates, beams, etc. in a variety of ASTM grades.

While some magnet structures have been proposed that include casings having flat top plates, these magnet structures either do not have a design that possesses the necessary strength and rigidity to lift heavy loads, or rely upon heavy cast structures or other heavy designs to provide such strength and rigidity. GB Patent Specification No. 29,863 and U.S. Pat. Nos. 2,491,743 and 4,009,459 disclose magnets having flat, unreinforced top plates.

U.S. Pat. No. 3,984,796 discloses a lifting magnet having a flat annular magnetic cover onto which are welded a plurality of radially extending fins. While the patent does not indicate the intended purpose of the fins, it is believed that the fins would function to dissipate heat that is generated during use of the magnet. Since the radially inner ends of the fins are not attached to each other, the fins do not define a structural support frame. The tapered shape of the fins also indicates that they were not provided as part of the support structure of the magnet.

U.S. Pat. No. 4,414,522 indicates in column 1, lines 47–61 that lifting magnets fabricated from steel plates typically included a plurality of flat steel plates welded together. Such an arrangement would be rather heavy and would not facilitate heat dissipation. U.S. Pat. No. 4,414,522 discloses welding a cast steel member to a cold-rolled steel plate to stiffen the steel plate. Accordingly, this patent also relies upon a structure that is cast from steel to provide the strength of the casing.

During operation, the electric coil of lifting magnets produces a great deal of heat. As the core of the lifting magnet heats up, its resistance drops, which is accompanied by a decrease in lifting power. Additionally, excessive heat build-up in the magnet reduces the useful life of the electric coil. Although some lifting magnets include heat dissipation fins, commercially available lifting magnets have a limited duty cycle of approximately 50%. In other words, the manufacturers recommend using a lifting magnet for only approximately one-half of a day (for example, in the morning) and then using a second lifting magnet for the second half of the day (for example, in the afternoon) so that neither lifting magnet becomes excessively heated. Since this would require the purchase of two magnets, such instructions typically are not followed. Accordingly, the lifting magnets become excessively heated, decreasing their lifting power and reducing their useful life.

Problems also exist concerning the manner in which the electric power supply cables are attached to conventional lifting magnets. Many conventional lifting magnets include an electrical connector box having a side wall through which the electric power supply cables are attached. The cables extending from the side of the electrical connector box are prone to being damaged during use, for example, by becoming caught on objects in the scrap yard. Additionally, the electric power supply cables typically are fixedly secured to the electric wires of the magnet electric coil (for example, using threaded connections or standard crimp joints). Accordingly, if excessive force is applied to the electric power supply cables, the wires that extend from the electric coil can be pulled out of the coil. This requires that the electric coil be repaired or replaced, which is time consuming and expensive.

SUMMARY OF THE INVENTION

It is an object of embodiments of the invention to provide a lifting magnet having a casing that is fabricated from structural material components that are welded together to form a support frame, rather than being cast. An example of a structural material is structural steel (cold- or hot-rolled steel), which can be purchased in a variety of ASTM grades, such as, for example, ASTM A36.

It is another object of embodiments of the invention to provide a lifting magnet that is lighter in weight than currently available lifting magnets having a comparable size and load bearing capacity.

It is another object of embodiments of the invention to provide a lifting magnet that has an improved ability to dissipate heat that is generated by the electric coil of the magnet so as to have an increased duty cycle.

In order to achieve the above and other objects, and to overcome the shortcomings in the prior art, a lifting magnet according to embodiments of the invention includes a casing that is fabricated from a plurality of components that are welded together. Preferably the lifting magnet is fabricated entirely from structural material components such as, for example, structural steel components that are welded together. In particular, the lifting magnet includes a flat top plate that is stiffened and supported by a support frame that is welded to the top plate. The support frame includes a plurality of stiffeners that extend from the center of the top plate to the radially outer edges of the top plate, the stiffeners being welded together at the center of the top plate. The stiffeners are shaped and arranged on the top plate so that the frame that the stiffeners form is capable of bearing the entire load that the lifting magnet is intended to withstand.

The top plate is attached (for example, by welding) to a cylindrical side wall, which functions as the magnet's outer pole shoe. A central core is welded to the lower surface of the top plate at a central portion of the top plate within the area surrounded by the cylindrical side wall. This central core functions as the inner pole shoe of the magnet.

A centering hub preferably is attached to the central core and extends through a central aperture in the top plate so as to protrude above the top plate. The radially inner ends of the radial stiffeners are attached to each other by being welded to the centering hub. Thus, the radial stiffeners are attached (for example by welding) to each other by the centering hub and to the top surface of the top plate. In a preferred embodiment, the top plate, the cylindrical side wall, the radial stiffeners, the central core and the centering hub all are made from structural steel such as, for example, ASTM A36 structural steel.

The lifting magnet also includes three pairs of lifting ears, also fabricated from a structural material, such as, e.g., ASTM A36 structural steel. The pairs of lifting ears are welded to the upper surface of the top plate and also are welded to arcuate cross stiffeners that extend between the radial stiffeners that are located on opposite sides of each pair of lifting ears. The bottom of each arcuate cross stiffener is welded to the upper surface of the top plate, while the ends of each arcuate cross stiffener are welded to the adjacent radial stiffeners. The lifting ears can be attached to lifting chains in a conventional manner for attachment of the lifting magnet to a crane, for example.

An electric coil is provided inside of the lifting magnet casing, between the cylindrical side wall and the central core. A bottom plate having a central aperture through which a lower end of the central core extends is welded to the outer surface of the central core and to the inner surface of the cylindrical side wall so as to enclose the electric coil. The bottom plate is made from a nonmagnetic material, preferably stainless steel, which is much less brittle than manganese, which is typically used to form the bottom plates of lifting magnets.

The electrical connector box of the lifting magnet preferably is arranged so that the electric power supply cables enter through the top of the electrical connector box. A slip-type connector is provided within the electrical connector box so as to provide for a slip connection between the electric power supply cables and the wires that extend from the electric coil. Accordingly, if excessive force is applied to the electric power supply cables, the slip connector will detach so that the electric coil and its wires remain undamaged.

The manner in which the lifting magnet is constructed, particularly the manner in which the casing is constructed, i.e., by welding together the various components detailed above (instead of by casting the entire casing or the support frame of the casing) also is considered to be an aspect of the invention.

Structural steel is of a much higher grade than cast steel, and does not have any of the porosity or sulfur content problems associated with cast steel. As stated earlier, structural steel can be obtained having specific predetermined strength characteristics. By using structural steel in a design that relies upon a frame constructed from stiffeners to bear the load of the lifting magnet, the size, number and positions of the stiffeners can be determined so that the resulting magnet will bear the desired load. The welds can be specifically designed to bear the desired load. The stiffeners preferably are positioned so as to equally distribute the load throughout the entire magnet.

The resulting magnet is much lighter in weight than conventional magnets having casings that are cast from steel and that have a comparable size and lifting capacity. Accordingly, when using the present magnet, the boom tip weight is reduced significantly. This allows the crane operator to extend the boom farther and to reach more areas than with conventional lifting magnets.

In addition to providing the structural support, the stiffeners also function to dissipate the heat that is generated by the electric coil of the magnet. It has been found that magnets constructed according to the present design do not become excessively heated even when operated for an entire day. Accordingly, it is possible to use the present lifting magnet all day long without shortening the life of the electric coil and without a decrease in lifting power.

It also has been found that lifting magnets constructed according to the present design have an increased lifting power of 20–30% over similarly sized lifting magnets that are cast from steel. In particular, it has been found that the lifting power at the cylindrical side wall (the outer pole shoe) is much greater than in conventional magnets. Although the reason why the lifting power of the present magnets is greater is not entirely understood, it is believed that the radially extending stiffeners of the support frame create well defined paths for the electromagnetic flux to travel from the inner pole shoe to the outer pole shoe. These well defined flux paths are much better than what results in conventional cast casings in which the large mass of cast steel causes the electromagnetic flux to wander.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
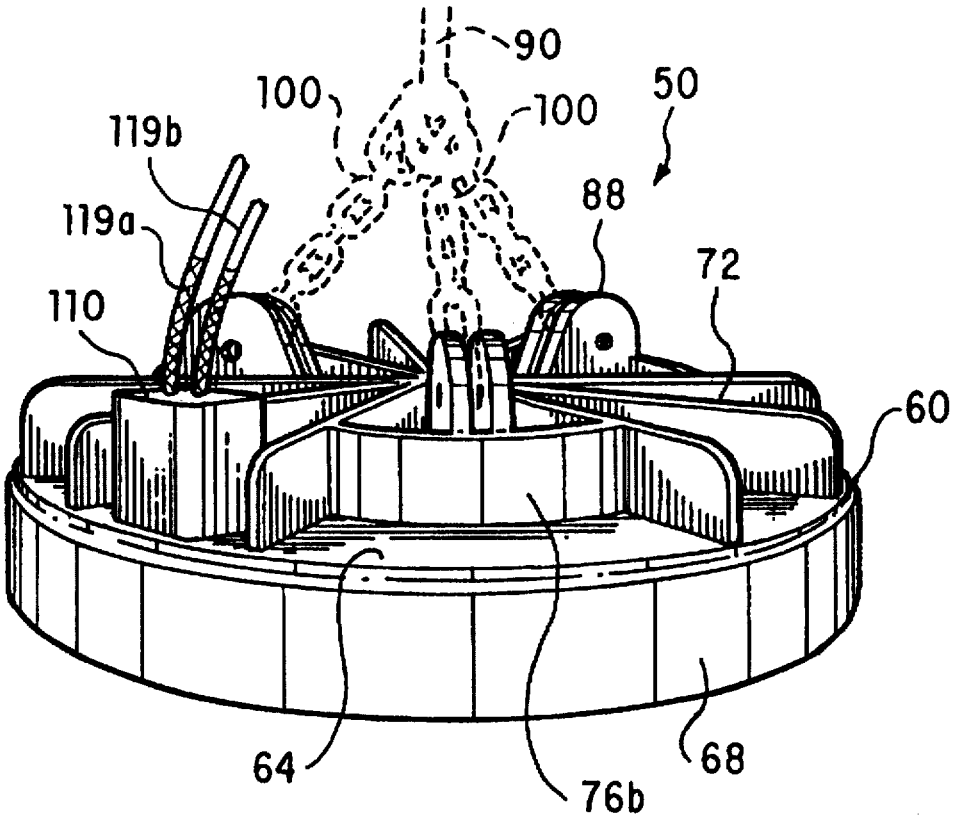
FIG. 1 is a perspective view of a first embodiment of a lifting magnet according to the invention.

A first embodiment of a lifting magnet according to the invention will be described with reference to FIGS. 1–10. FIG. 1 is a perspective view of a first lifting magnet that embodies the invention. Lifting magnet 50 includes an outer permeable magnetic casing 60 that contains one or more electric coil windings as is well known in the art. As is also well known, the lifting magnet 50 is suspended at three locations by chains 100, which can be hung from a hook 90 or other linkage device of a crane, for example. Electric power is supplied to the electric coil of the lifting magnet 50 by two electric power supply cables 119*a* and 119*b*, which are attached to an electrical connector box 110 of the lifting magnet 50. Alternatively, one electric power supply cable could be provided.

The casing 60 of lifting magnet 50 is fabricated from a plurality structural steel components that are welded together. As mentioned above, components made from structural steel, which can be, for example, hot- or cold-rolled steel, typically will be of a much higher quality and will have a much more consistent grading than components that are cast from steel. Thus, rather than casting the casing from steel and relying on the unitary (one-piece) casting to provide the stiffness and strength of the casing, the FIG. 1 design relies upon an integral support frame that is fabricated by welding together a plurality of radially extending stiffeners 72 to bear the load of the lifting magnet. Therefore, the present casing has a much lighter weight than casings that are cast from steel and that have a comparable size and load bearing capacity. The stiffeners 72 are welded to a circular, flat top plate 64. The outer circumference of the top plate 64 is welded to a cylindrical side wall 68, which functions as the outer pole shoe of the magnet.

Figure 2:
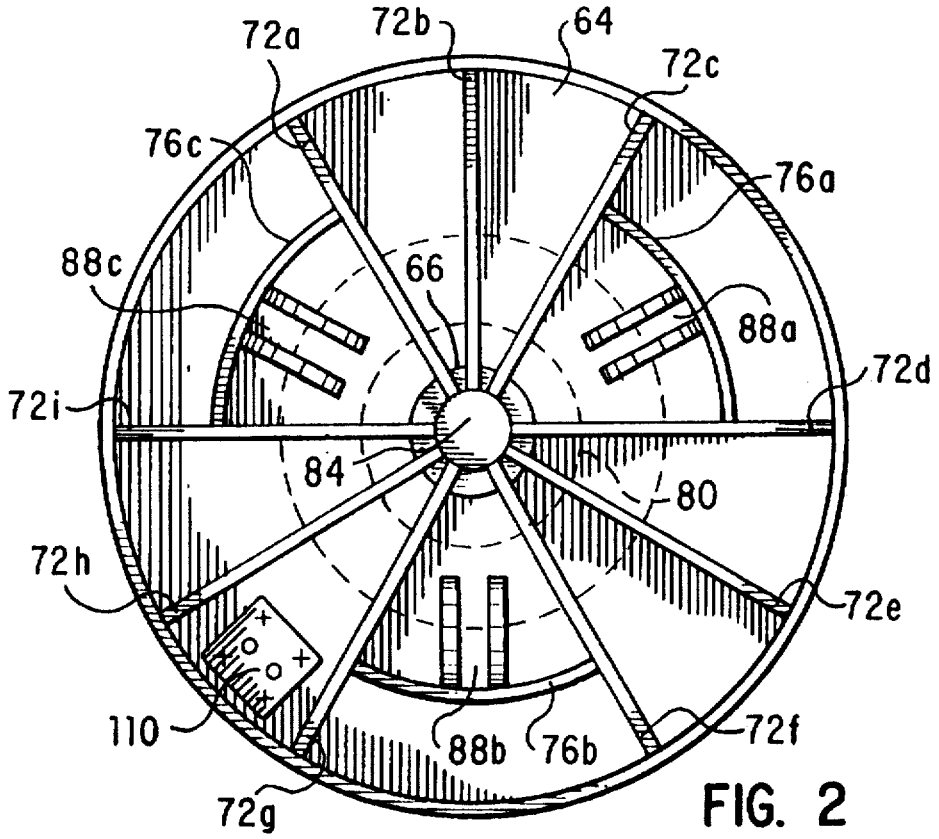
FIG. 2 is a top view of the FIG. 1 lifting magnet.
Figure 8:
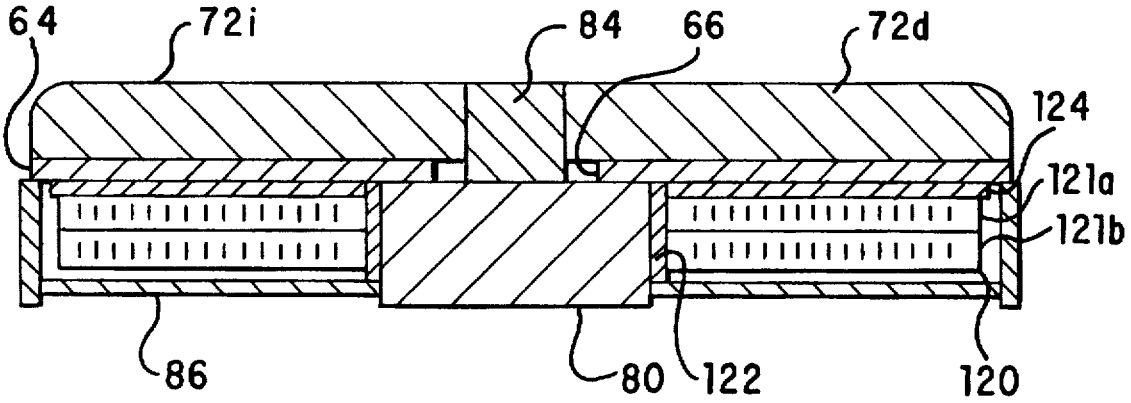
FIG. 8 is a side cross-sectional view through the center of the FIG. 1 lifting magnet and also shows the electric coil inside the lifting magnet.

Referring to FIGS. 2 and 8, it can be seen that a permeable magnetic central core 80, which forms the inner pole shoe when the electric coil is energized, is welded to the lower surface of top plate 64 at the center of the top plate 64. A solid, cylindrical centering hub 84 is welded to the center top surface of central core 80 and extends through a central aperture 66 in the top plate 64. In the FIG. 1 embodiment, nine radially extending stiffeners 72*a*–72*i* are provided on the upper surface of top plate 64 and extend from centering hub 84 to the radially outer edge of top plate 64. Thus, each stiffener 72*a*–72*i* extends from within the radially inner periphery of top plate 64 to the radially outer periphery of top plate 64. The lower surface of each radially extending stiffener is welded to the upper surface of top plate 64 along the entire length of the stiffener that is in contact with the top plate 64. The radially inner ends of the stiffeners 72*a*–72*i* are welded to each other to define a support frame by being welded to the outer surface of centering hub 84. As can be seen from the drawings, each of the stiffeners 72*a*–72*i* protrudes vertically above the upper surface of top plate 64 by an amount sufficient to impart the desired strength to the support frame.

As is apparent from FIG. 2, the radially extending stiffeners 72*a*–72*i* are provided at regular intervals. In the first embodiment, the radially extending stiffeners are provided at 30° intervals except at the three locations where the lifting ear pairs 88*a*–88*c* are located. At such positions, the lifting ear pairs 88*a*–88*c* are provided in place of a radially extending stiffener. In order to more evenly spread the load about the centerline of the magnet, cross stiffeners 76*a*–76*c*, having an arcuate shape, are provided between the radially extending stiffeners that are located on either side of each lifting ear pair 88*a*–88*c*. The cross stiffeners 76*a*–76*c* are located at a radial position that is slightly greater than one-half the radius of the top plate 64. The arcuate cross stiffeners 76*a*76*c* are welded to the upper surface of the top plate 64, to the radially extending stiffeners between which they extend, and to the corresponding pair of lifting ears 88*a*–88*c*, respectively.

Figure 9:
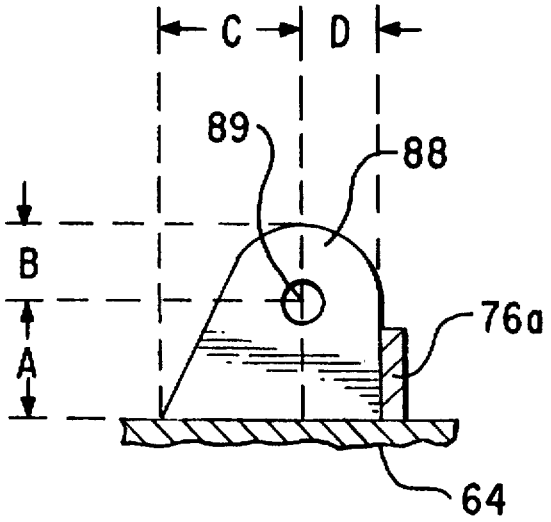
FIG. 9 is a side view of one of the lifting ears in the FIG. 1 lifting magnet.

Thus, in the first embodiment, three groups of radially extending stiffeners are provided, each group having three radially extending stiffeners therein. An arcuate cross stiffener and a pair of lifting ears is provided between each group of radially extending stiffeners. Referring to FIG. 2, radially extending stiffener 72*b* is spaced 30° from radially extending stiffener 72*a*. Radially extending stiffener 72*c* is spaced 30° from stiffener 72*b*. Radially extending stiffener 72*d* is spaced 60° from stiffener 72*c*, with the pair of lifting ears 88*a* located midway between stiffeners 72*c* and 72*d*. In other words, lifting ear pair 88*a* is located 30° from stiffener 72*c* and 30° from stiffener 72*d*. Arcuate cross stiffener 76*a* is welded to the upper surface of top plate 64. Opposite ends of arcuate cross stiffener 76*a* are welded to stiffeners 72*c* and 72*d*, respectively. Additionally, the radially outer edges of the individual lifting ears 88 in lifting ear pair 88*a* are welded to the radially inner surface of arcuate cross stiffener 76*a* as illustrated in FIG. 9. The lower surfaces of the individual ears 88 in lifting ear pair 88*a* are welded to the upper surface of top plate 64. Attachment of the lifting ear pairs to the arcuate cross stiffeners serves to stabilize the lifting ear pairs, making it much more unlikely that they could be knocked over should they be accidentally struck from the side. As can be seen from FIG. 2, a similar layout is provided for the remaining radially extending stiffeners 72*e*–72*i*, the remaining arcuate cross stiffeners 76*b* and 76*c* and the remaining lifting ear pairs 88*b* and 88*c*.

Figure 3:
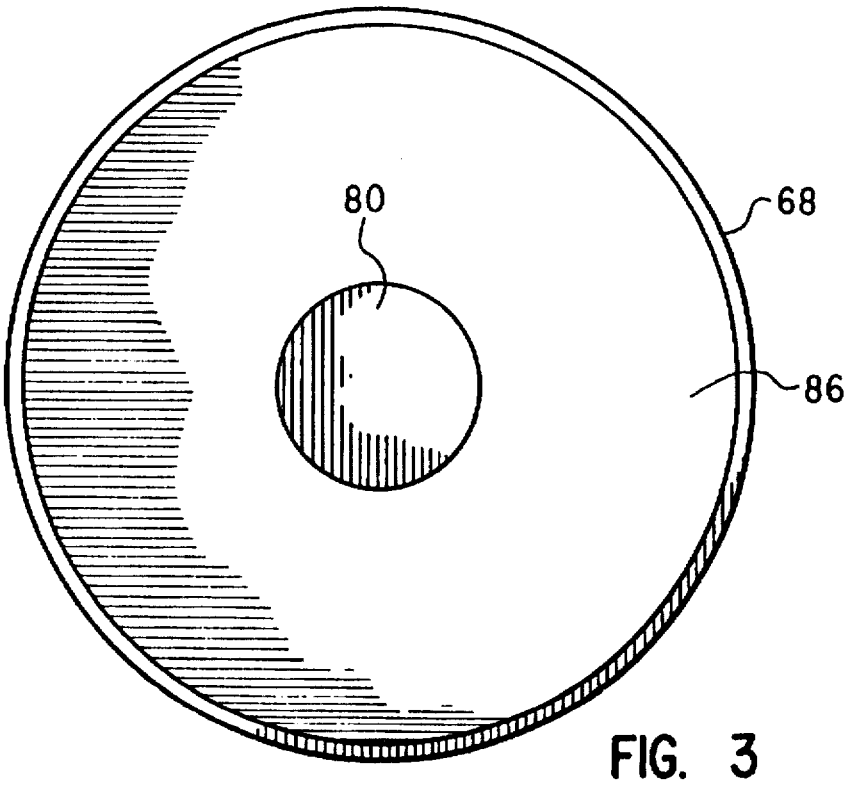
FIG. 3 is a bottom view of the FIG. 1 lifting magnet.
Figure 4:
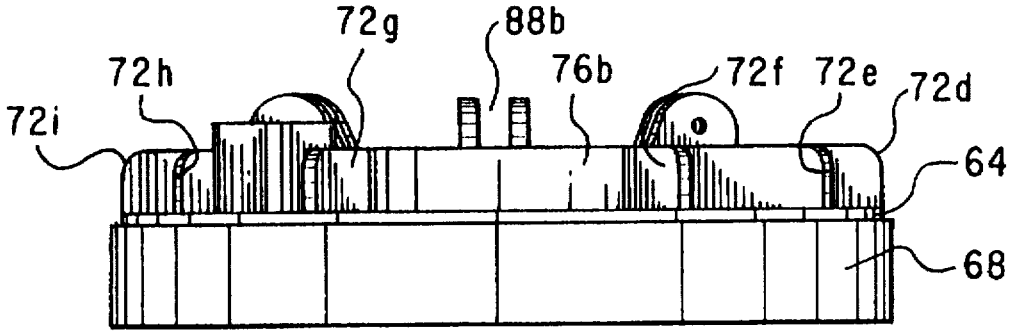
FIG. 4 is a front view of the FIG. 1 lifting magnet.
Figure 5:
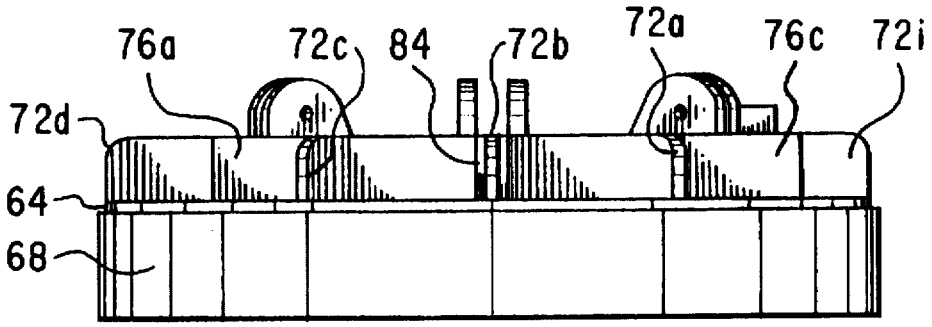
FIG. 5 is a rear view of the FIG. 1 lifting magnet.
Figure 6:
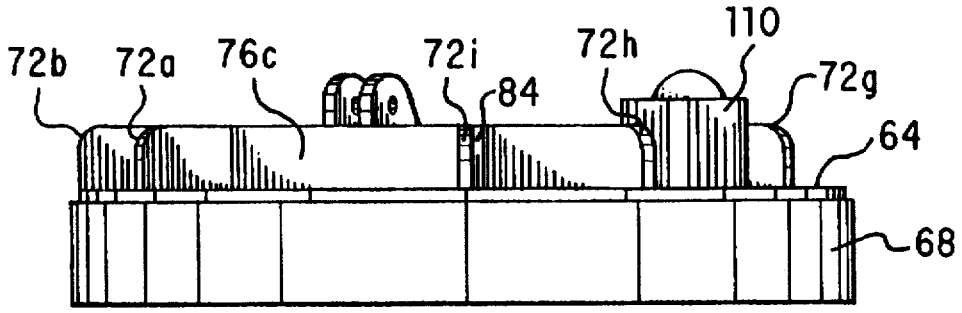
FIG. 6 is a left side view of the FIG. 1 lifting magnet.
Figure 7:
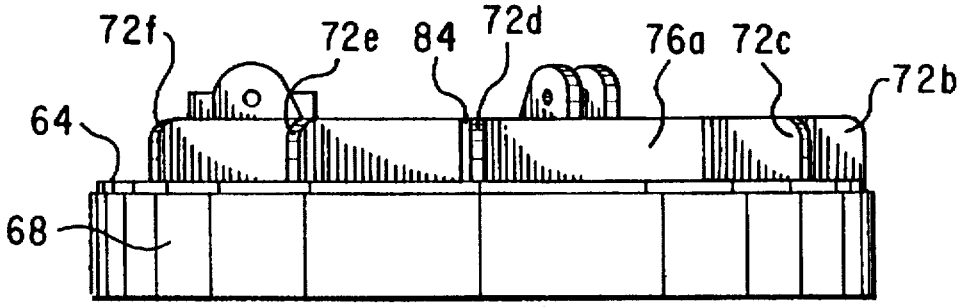
FIG. 7 is a right side view of the FIG. 1 lifting magnet.
Figure 11:
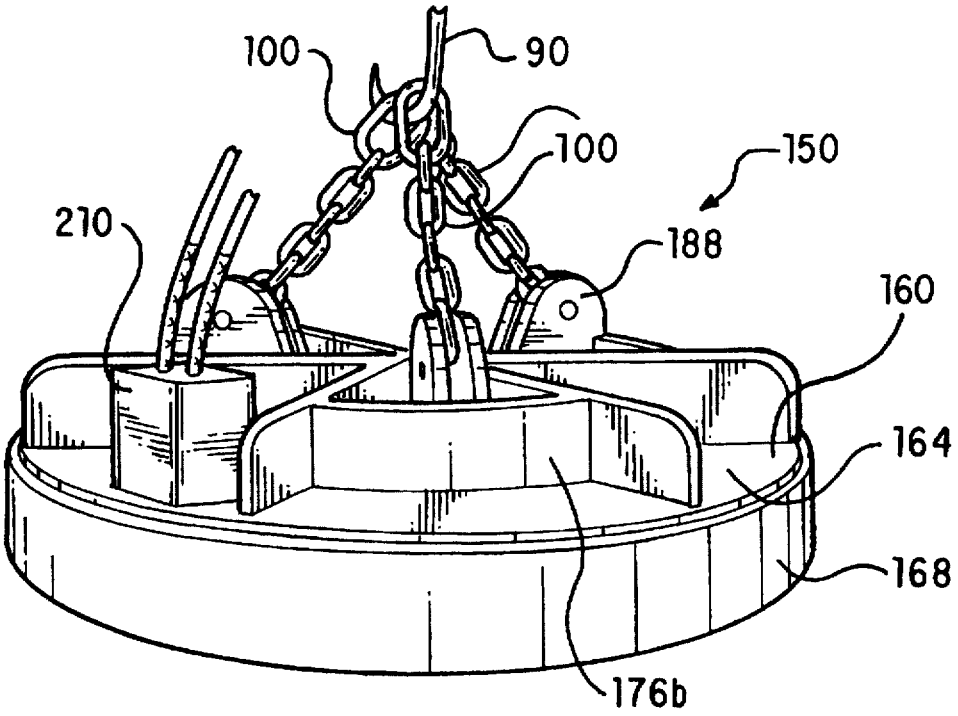
FIG. 11 is a perspective view of a second embodiment of the invention.

An electric coil is provided within the casing 60. As shown in FIG. 8, the electric coil 120 includes a flat, annular winding plate 124 that is attached to a ring-like winding hub 122. A pair of electrical windings 121*a* and 121*b* are wrapped around the winding hub 122 and are supported by the winding plate 124. The electric coil is placed between the central core 80 and the cylindrical side wall 68. A circular bottom plate 86 having a central aperture through which the bottom of the central core 80 extends is then welded to the outer circumference of central core 80 and to the inner circumference of cylindrical side wall 68 to seal the electric coil within the casing 60. This arrangement is best seen in FIG. 3, which is a bottom view of the lifting magnet.

FIGS. 4–7 are views of the FIG. 1 lifting magnet from the front, rear, left side and right side, respectively.

Fabricating the casing 60 of the lifting magnet 50 from a plurality of components that are welded together (and particularly fabricating a frame-like support structure of the casing from stiffeners that are welded together) instead of casting the magnet casing results in a rugged, light-weight casing. Each of the individual components can be selected (i.e., the material and the dimensions can be selected) based upon the results of bending moment analysis for a predetermined magnet size and maximum load bearing capacity. For example, the FIG. 1 embodiment is appropriate for a lifting magnet having a 66 inch diameter and capable of withstanding a vertical load of 70,000 pounds.

By attaching the radially extending stiffeners 72 between the center and approximately the outer circumference of the magnet casing, the assembly of radially extending stiffeners forms an integral supporting frame for the remainder of the lifting magnet (i.e., the top plate 64 and the other components located thereunder). Additionally, attaching the radially extending stiffeners between the inner pole shoe (i.e., the central core 80) and the outer pole shoe (i.e., the cylindrical side wall 68) enables the stiffeners 72*a*–72*i* to function so as to efficiently channel the electromagnetic flux from the inner pole shoe to the outer pole shoe. The stiffeners also increase the surface area of the casing, which serves to dissipate heat. Thus, the supporting frame defined by the radially extending stiffeners serves the multiple functions of providing structural support for the lifting magnet, efficiently channeling electromagnetic flux to the outer pole shoe and dissipating heat generated by the electric coil of the magnet.

A lifting magnet having the FIG. 1 design and having a 66 inch outer diameter and having a 70,000 pound vertical load bearing capacity was constructed with components having the following dimensions. All components, with the exception of the electric coil and the bottom plate 86 were formed from ASTM A36 structural steel. The bottom plate 86 was constructed from 304 stainless steel, which is non-magnetic and much less brittle than most conventional bottom plates, which are constructed from manganese. The electric coil was constructed from two windings separated by a fiberglass board and sandwiched between two other fiberglass boards as is well known. The central board had a thickness of 0.0625 inches, while the end boards had respective thicknesses of 0.25 inches and 0.125 inches. Each winding was constructed by winding an aluminum conductor 0.027 inches thick and 2.7 inches high, with an insulative material such as Nomex (0.003 inches thick and 2.875 inches high) placed between each turn. Each winding included 658 turns and 602 pounds of conductor. The total coil resistance was 2.44 ohms when energized with 230 Volts DC (=94 amps. cold). The top plate 64 had an outer diameter of 65 inches and included a central aperture 66 having a diameter of 10 inches. The thickness of the top plate 64 was 1.25 inches. The radially extending stiffeners 72*a*–72*i* each had a thickness of 1 inch, a height of 6 inches and a length of 30.5 inches. The central core 80 had a height of 8 inches and a diameter of 17.5625 inches. The central hub 84 had a height of 7.25 inches and a 4 inch diameter. The cylindrical side wall 68 was formed by rolling a 1.5 inch thick sheet having a width of 8 inches and a length of 17 feet, 3.25 inches into a ring having an outer diameter of 66 inches. The ends of the sheet were welded together. The arcuate cross stiffeners 76*a*–76*c* had a thickness of 1 inch, a height of 6 inches and a length of 21 inches and were curved so as to have an inner radius of 21 inches. Each lifting ear had a thickness of 1.25 inches, an aperture 89 having a diameter of 2.125 inches, and the following other dimensions, with reference to FIG. 9: A=7.25 inches, B=4.5 inches, C=7.75 inches, D=4.5 inches. The stainless steel bottom plate had a thickness of 0.75 inches, an outer diameter of 62.75 inches and a central aperture having a diameter of 17.875 inches.

This lifting magnet (including the electric coil) had a total weight of approximately 5600 pounds, which is approximately 800–1200 pounds lighter than conventional lifting magnets having cast steel casings with a 66 inch outer diameter. Thus, when using the present magnet, the boom tip weight (the weight at the end of the boom) is reduced significantly. This allows the crane operator to extend the boom farther and to reach more areas than with heavier conventional lifting magnets.

In addition to providing the structural support, the present design has been found to dissipate heat in an extremely efficient manner. It has been found that magnets constructed according to the present design do not become excessively heated even when operated for an entire day. Accordingly, it is possible to use the present lifting magnet all day long without shortening the life of the electric coil and without a decrease in lifting power.

It also has been found that lifting magnets constructed according to the present design have an increased lifting power of 20–30% over similarly sized lifting magnets having a cast steel casing. In particular, it has been found that the lifting power at the cylindrical side wall (the outer pole shoe) is much greater than in conventional magnets. Although the reason why the lifting power of the present magnet is greater than conventional magnets is not entirely understood, it is believed that the radially extending stiffeners of the support frame create well defined paths for the electromagnetic flux to travel from the inner pole shoe to the outer pole shoe. These well defined flux paths are much better than what results in conventional cast casings in which the large mass of cast steel causes the electromagnetic flux to wander.

Thus, the present light-weight design promotes increased heat dissipation, providing longer operator usage without sacrificing lifting capability. The rugged, light-weight fabricated steel casing having the supporting frame fabricated from a plurality of stiffeners that are welded together promotes heat dissipation while simultaneously providing superior unit structure strength and efficient electromagnetic flux transport.

Figure 10:
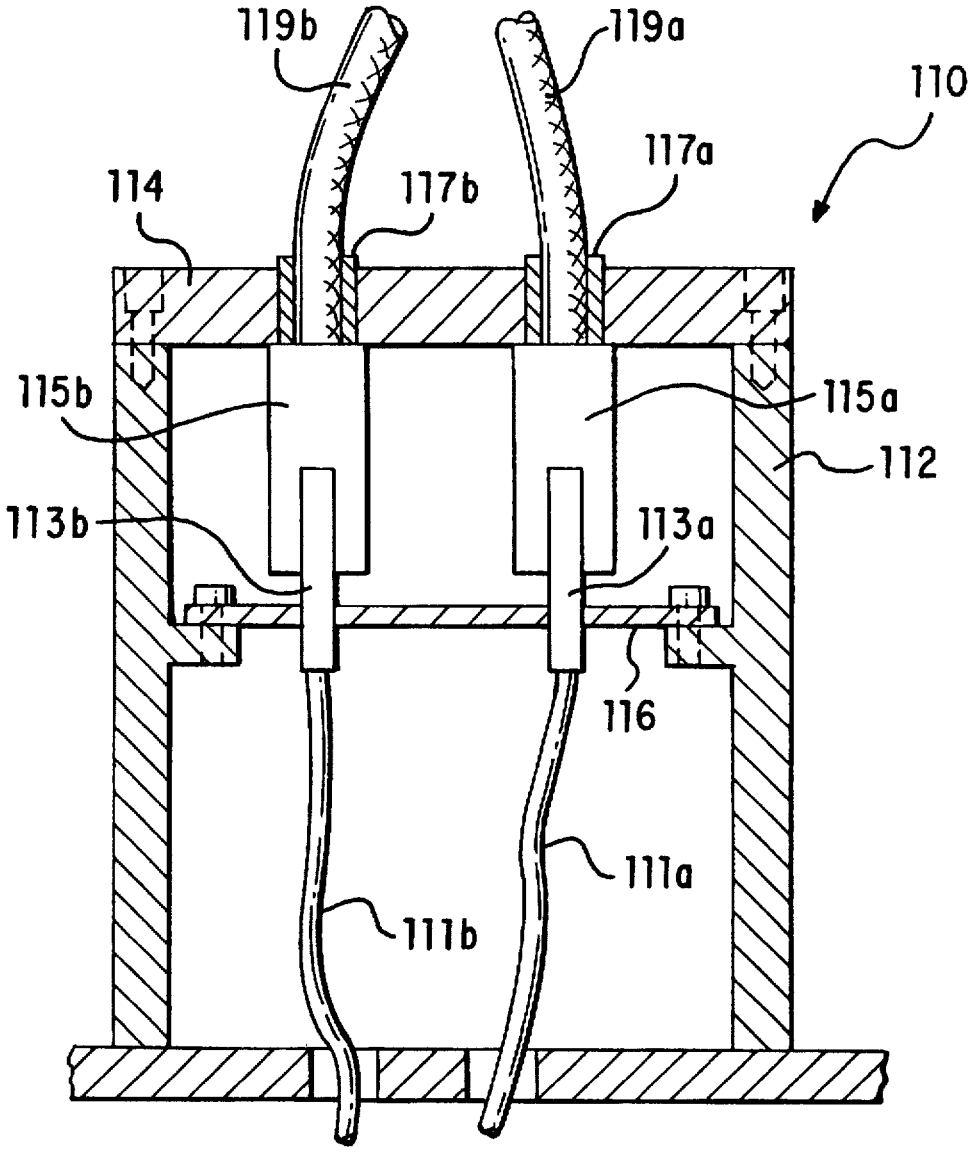
FIG. 10 is a schematic view showing the internal components of the electrical connector box of the FIG. 1 lifting magnet.
Figure 12:
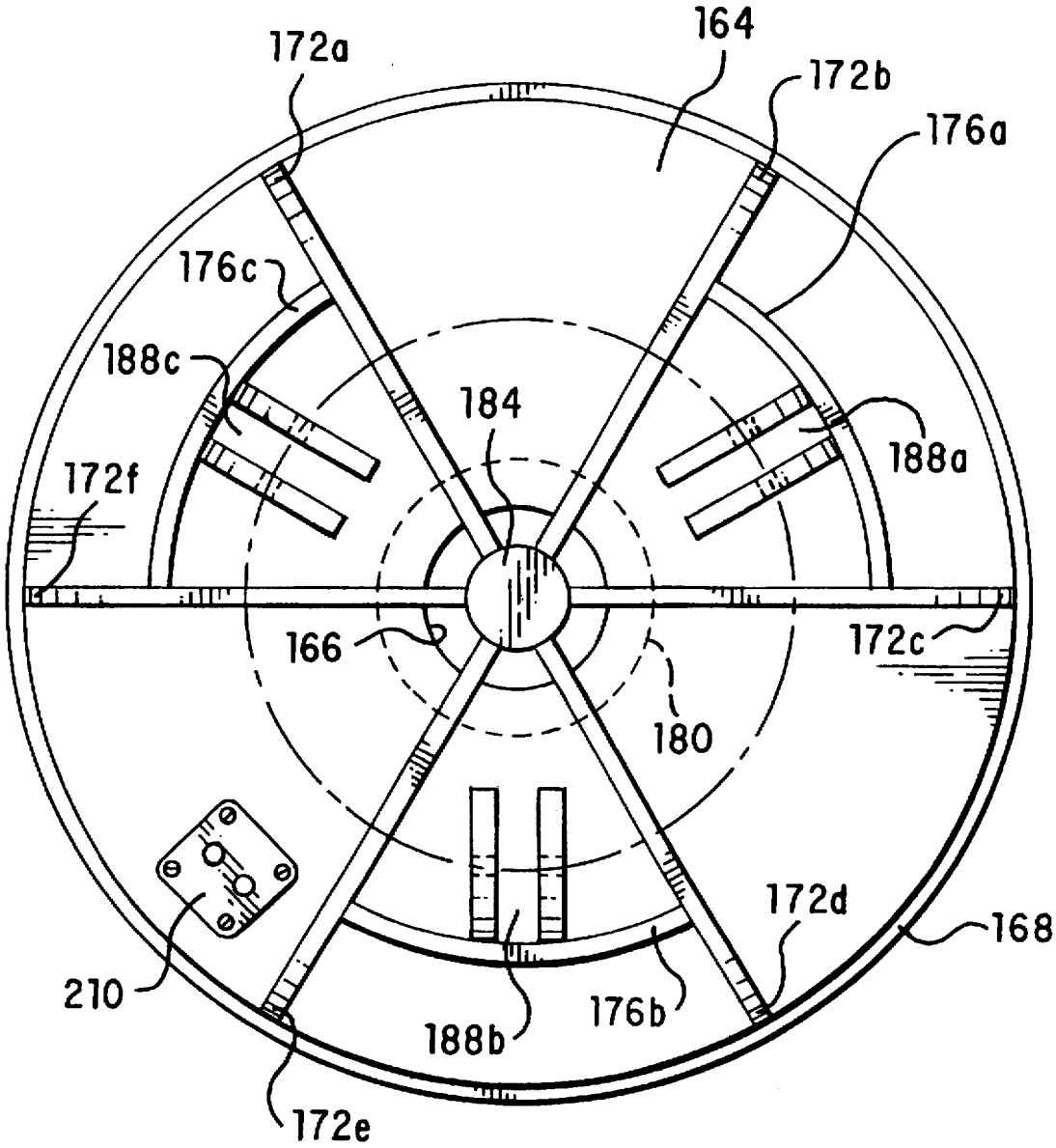
FIG. 12 is a top view of the FIG. 11 lifting magnet.
Figure 13:
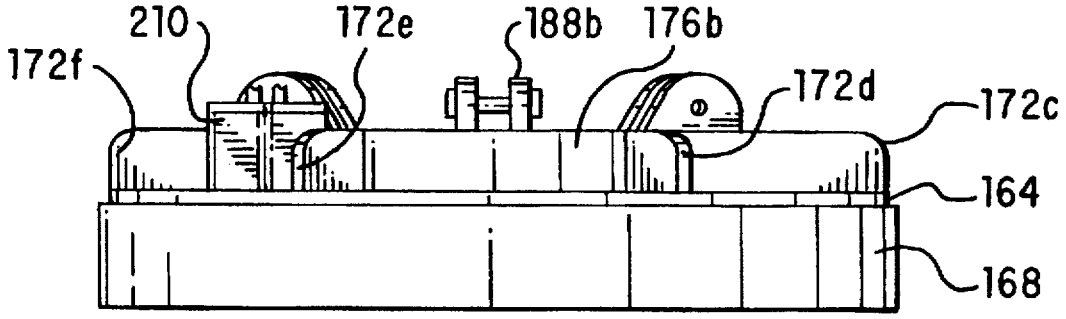
FIG. 13 is a front view of the FIG. 11 lifting magnet.
Figure 14:
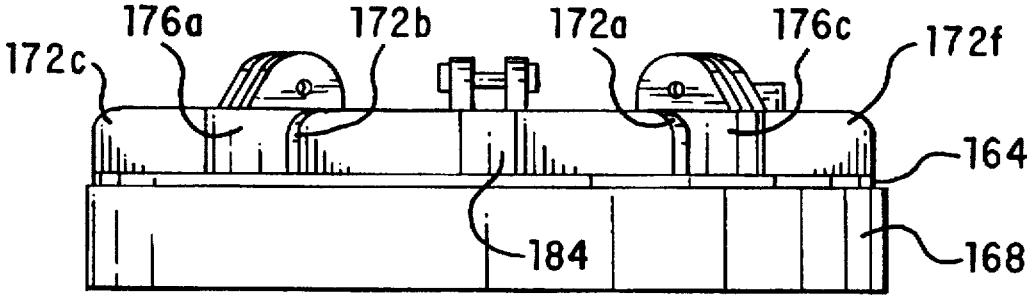
FIG. 14 is a rear view of the FIG. 11 lifting magnet.
Figure 15:
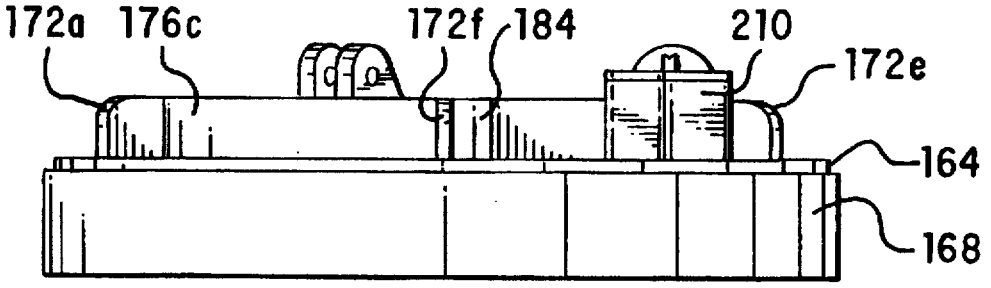
FIG. 15 is a left side view of the FIG. 11 lifting magnet.
Figure 16:
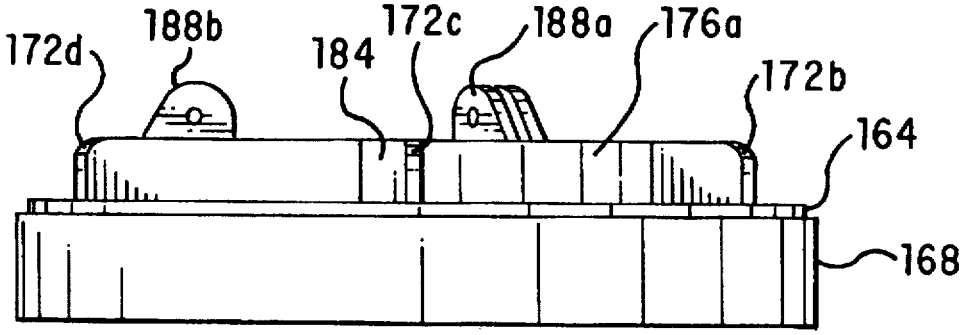
FIG. 16 is a right side view of the FIG. 11 lifting magnet.

Although the present casing can be used with a variety of different electrical connector boxes, the design of a preferred electrical connector box is shown in FIG. 10. The electrical connector box 110 allows the electric power supply cables 119*a* and 119*b* to enter the box vertically. The electrical connector box 110 includes an outer housing 112 of structural steel that is welded to the upper surface of top plate 64. An insulating substrate 116 is attached (for example, by screws) to supporting tabs that protrude from the inner walls of housing 112. The electric wires 111*a* and 111*b* from the electric coil 120 extend into a lower portion of the electrical connector box 110 and are provided with first portions 113*a* and 113*b* of slip connectors. The slip connectors can be, for example, Tweeco plugs. In the present example, the first portions 113*a* and 113*b* are male connectors, although they could be female connectors or other slip-type connectors. Connector portions 113*a* and 113*b* are fixedly mounted to the insulating board 116. A cover 114 for the electrical connector box 110 is removably attached to housing 112 by, for example, bolts that are recessed into the cover 114. The electrical power supply cables 119*a* and 119*b* pass through apertures in the cover 114 and are attached to female connector portions 115*a* and 115*b* of the slip connectors. Connector portions 115*a* and 115*b* could be male connector portions or other slip-type connectors. Portions 115*a* and 115*b* are fixedly mounted on the inside surface of cover 114. Insulating fittings 117*a* and 117*b* (e.g., rubber fittings) can be provided between the electric power supply cables 119*a* and 119*b* and the apertures in the cover 114.

When the cover is bolted to the top of housing 112, the connector portion 115*a* slidably engages connector portion 113*a*, while the connector portion 115*b* slidably engages the connector portion 113*b*. If excessive force should be applied to the electric power supply cables 119*a* and 119*b*, which can occur, for example, when the electric power supply cables become hung up on external structures such as scrap, the electrical connector portions 115*a* and 115*b* will slidably disengage from their respective connectors 113*a* and 113*b* (once the cover 114 is pulled from the housing 112). Accordingly, the electric wires 111*a* and 111*b* from the electric coil will not become damaged.

While the FIG. 1 embodiment includes nine radially extending stiffeners, it is possible to include more than nine radially extending stiffeners or less than nine radially extending stiffeners while practicing the present invention. As few as three radially extending stiffeners can be provided. Generally, the number of stiffeners depends on the diameter of the magnet and the maximum load that the magnet is intended to withstand. For example, smaller magnets having an outer diameter of 47 inches or 37 inches typically would require only six radially extending stiffeners. Larger magnets, such as 78 inch diameter magnets, might use twelve radially extending stiffeners. Of course, it is possible to provide more stiffeners than is necessary from a load bearing standpoint, if it was desired to increase the heat dissipation capacity of the magnet.

A 47 inch magnet is illustrated in FIGS. 11–16. The elements in FIGS. 11–16 are similar to those from the first embodiment and merely are labeled with numbers that are 100 greater than those of the first embodiment to distinguish therebetween. As is apparent, only six radially extending stiffeners 172*a*–172*f* are included. In the second embodiment, the lifting ear pairs 188*a*–188*c* are not provided in place of any radially extending stiffeners, but each ear pair is still symmetrically located between two radially extending stiffeners and attached to a corresponding arcuate cross stiffener 176*a*–176*c*.

In smaller magnets such as the 37 inch diameter magnet, it may be possible to delete the arcuate cross stiffeners. However, the arcuate cross stiffeners are advantageous in that they support the lifting ears against lateral deflection. The cross stiffeners need not be arcuate in shape, although such a shape distributes the load better in a circular magnet.

Designs that include stiffeners welded to a top plate in an arrangement other than the radially extending arrangement of the disclosed embodiments also are possible, and are within the scope of this invention, although such arrangements probably would not function as well in conveying electromagnetic flux from the inner pole shoe to the outer pole shoe. For example, a honeycomb arrangement of stiffeners welded together and welded to the upper surface of the top plate also would provide adequate structural support for the lifting magnet.

It also is possible to use materials other than ASTM A36 structural steel, although this material provides good strength and magnetic flux carrying characteristics (i.e., good magnetic permeability) at a reasonable price. T1 steel, which is a thin-gauged rolled steel, also could be used, for example.

It also would be possible to fabricate the present magnets by welding together a plurality of cast steel components (stiffeners, top plates, lifting ears, etc.), although such a construction would not be preferred because it likely would suffer from the porosity problems mentioned earlier and likely would be heavier than structural steel embodiments. For example, in order to achieve the same strength characteristics and to minimize porosity problems, it probably would be necessary to cast the stiffeners so that they had a tapered cross-section (wider at the bottom (which is welded to the top plate) and narrower at the top). This would increase the weight of the magnet and likely would be more expensive to manufacture.

The manner in which the lifting magnet is constructed, particularly the manner in which the casing is constructed, i.e., by welding together the various components detailed above (instead of by casting the entire casing or the support frame of the casing) also is considered to be an aspect of the invention.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A fabricated electric lifting magnet casing comprised of a plurality of individual components that are welded together, said components including:

a flat, structural steel, top plate having a first major surface and a second major surface facing in a direction opposite of the first major surface;

a plurality of stiffener members made from structural steel, said stiffener members being welded to each other to define an integral support frame, said stiffener members having a height, a width and a length, the length being substantially longer than the height and the width, said stiffener members being welded to the first surface of said flat top plate along the lengths of the stiffener members, an outer side wall located at an outer circumference of said flat top plate and welded to the second surface of said flat top plate; and a central core welded to a central portion of said second surface of said flat top plate.

2. The casing of claim 1, wherein said flat top plate has a constant thickness.

3. The casing of claim 1, wherein said flat top plate is round.

4. The casing of claim 1, wherein each of said plurality of stiffener members extends from a center of said flat top plate to a peripheral edge of said flat top plate, said plurality of stiffener members being welded to each other at the center of said flat top plate, said plurality of stiffener members being symmetrically disposed on said first surface of said flat top plate.

5. The casing of claim 4, wherein said flat top plate is round.

6. The casing of claim 4, further comprising a plurality of cross stiffener members, each of said cross stiffener members being welded to said first surface of said flat top plate, each of said cross stiffener members having opposite ends welded to two adjacent stiffener members of said integral support frame.

7. The casing of claim 1, further comprising a plurality of lifting ear pairs welded to said first surface of said flat top plate.

8. The casing of claim 7, further comprising a plurality of cross stiffener members, corresponding in number to said plurality of lifting ear pairs, each of said cross stiffener members being welded to said first surface of said flat top plate and to a corresponding lifting ear pair, each of said cross stiffener members having opposite ends welded to two adjacent stiffener members of said integral support frame.

9. The casing of claim 1, wherein said individual components are cold-rolled steel components or hot-rolled steel components.

10. The casing of claim 1, wherein said flat top plate includes a central aperture, said casing further comprising a centering hub welded to said central core and extending through said central aperture of said flat top plate, one end of each of said plurality of stiffener members being welded to said centering hub to attach said stiffener members to each other, thereby defining said integral support frame.

11. A fabricated electric lifting magnet comprising:

a flat, annular top plate having a circular outer circumference, a central aperture, an upper surface and a lower surface;

a central core attached to a central portion of the lower surface of said top plate below said central aperture, said central core functioning as an inner pole shoe of said lifting magnet;

a cylindrical outer side wall attached to an outer peripheral portion of the lower surface of said top plate, said cylindrical outer side wall functioning as an outer pole shoe of said lifting magnet;

an electric coil located between said central core and said cylindrical outer side wall;

a flat, annular nonmagnetic bottom plate attached between an outer surface of said central core and an inner surface of said cylindrical side wall, said electric coil located between said bottom plate and said top plate;

a plurality of lifting ears attached to the upper surface of said top plate; and an integral support frame attached to the upper surface of said top plate and fabricated from a plurality of individual components that are attached to each other, said integral support frame comprising:

a centering hub attached to an upper surface of said central core and extending through said central aperture of said top plate; and a plurality of radially extending stiffener members, each of said radially extending stiffener members having an inner end attached to said centering hub, an outer end that extends to the outer peripheral portion of said top plate, and a lower surface that is attached to the upper surface of said top plate.

12. The lifting magnet of claim 11, wherein said flat top plate has a constant thickness.

13. The lifting magnet of claim 11, further comprising a plurality of cross stiffener members, each of said cross stiffener members being attached to the upper surface of said flat top plate, each of said cross stiffener members having opposite ends attached to two adjacent radially extending stiffener members of said integral support frame.

14. The lifting magnet of claim 13, wherein said lifting ears are provided in pairs, said lifting magnet including a plurality of said lifting ear pairs corresponding in number to said plurality of cross stiffener members, each of said cross stiffener members being attached to a corresponding lifting ear pair.

15. The lifting magnet of claim 11, wherein said integral support frame includes at least three of said radially extending stiffener members.

16. The lifting magnet of claim 15, wherein said integral support frame includes nine of said radially extending stiffener members.

17. The lifting magnet of claim 16, wherein said stiffener members are disposed on the upper surface of said top plate in three groups of three stiffener members per group, said groups being distributed at 120° intervals about the center of said top plate, said stiffener members of each group being spaced at 30° intervals.

18. A fabricated electric lifting magnet comprising:

a flat, structural steel, top plate having an outer circumference, an upper surface and a lower surface;

a central core welded to a central portion of the lower surface of said top plate, said central core functioning as an inner pole shoe of said lifting magnet;

a structural steel outer side wall welded to an outer peripheral portion of the lower surface of said top plate, said outer side wall functioning as an outer pole shoe of said lifting magnet;

an electric coil located between said central core and said outer side wall;

a flat, nonmagnetic bottom plate welded between an outer surface of said central core and an inner surface of said side wall, said electric coil located between said bottom plate and said top plate;

a plurality of lifting ears welded to the upper surface of said top plate; and an integral support frame welded to the upper surface of said top plate and fabricated from a plurality of individual components that are attached to each other, said integral support frame comprising a plurality of radially extending stiffener members made from structural steel, each of said radially extending stiffener members having an inner end attached to the inner ends of the other radially extending stiffener members, an outer end that extends to the outer peripheral portion of said top plate, and a lower surface that is welded to the upper surface of said top plate.

19. The lifting magnet of claim 18, further comprising a plurality of cross stiffener members, each of said cross stiffener members being welded to the upper surface of said flat top plate, each of said cross stiffener members having opposite ends attached to two adjacent radially extending stiffener members of said integral support frame.

20. The lifting magnet of claim 18, wherein said lifting ears are provided in pairs, said lifting magnet including a plurality of said lifting ear pairs corresponding in number to said plurality of cross stiffener members, each of said cross stiffener members being welded to a corresponding lifting ear pair.

21. The lifting magnet of claim 18, wherein said integral support frame includes at least six of said radially extending stiffener members.

22. The lifting magnet of claim 21, wherein said integral support frame includes nine of said radially extending stiffener members.

23. The lifting magnet of claim 22, wherein said stiffener members are disposed on the upper surface of said top plate in three groups of three stiffener members per group, said groups being distributed at 120° intervals about the center of said top plate, said stiffener members of each group being spaced at 30° intervals.

24. The lifting magnet of claim 23, further comprising three arcuate cross stiffener members, each of said cross stiffener members being welded to the upper surface of said flat top plate, each of said cross stiffener members being located between two of said groups of stiffener members and having opposite ends attached to two adjacent radially extending stiffener members of said integral support frame.

25. The lifting magnet of claim 18, wherein the outer circumference of the flat top plate is circular and the outer side wall is cylindrical.

26. A fabricated electric lifting magnet casing comprised of a plurality of individual components that are welded together, said components including:

a flat, structural steel, top plate having a first surface and a second surface facing in a direction opposite of the first surface;

a plurality of structural steel stiffener members, said stiffener members having first ends that are welded to each other to define an integral support frame, apart from the top plate, said stiffener members extending radially outward from the location where the first ends are welded to each other, the stiffener members having a height, a width and a length, the length being substantially longer than the height and the width, said stiffener members being welded to the first surface of the top plate along the lengths of the stiffener members;

an outer side wall located at an outer circumference of said top plate and welded to the second surface of said top plate; and a central core welded to a central portion of said second surface of said top plate.

27. The casing of claim 26, wherein the flat top plate is round..

28. The casing of claim 26, further comprising a plurality of lifting ears welded to the first surface of the top plate.

29. The casing of claim 26, wherein the components further include a plurality of structural steel cross stiffener members, each of the cross stiffener members having opposite ends welded to two adjacent stiffener members of the integral support frame and also being welded to the first surface of the top plate.

* * * * *